US009637289B1

(12) United States Patent
Galomb

(10) Patent No.: US 9,637,289 B1
(45) Date of Patent: May 2, 2017

(54) PACKAGE CLOSURE WITH ROTATABLE MATERIAL STRIPPING ELEMENT

(71) Applicant: David E Galomb, Allentown, PA (US)

(72) Inventor: David E Galomb, Allentown, PA (US)

(73) Assignee: GALOMB, INC., Allentown, PA (US)

( * ) Notice: Subject to any disclaimer, the term of this patent is extended or adjusted under 35 U.S.C. 154(b) by 0 days.

(21) Appl. No.: 14/732,799

(22) Filed: Jun. 8, 2015

Related U.S. Application Data

(60) Provisional application No. 62/009,103, filed on Jun. 6, 2014.

(51) Int. Cl.
*B65D 51/24* (2006.01)
*B65D 47/06* (2006.01)

(52) U.S. Cl.
CPC ..... *B65D 51/24* (2013.01); *B65D 47/06* (2013.01)

(58) Field of Classification Search
CPC ..... B65D 51/24; B65D 47/06
USPC ..... 222/148, 149, 151, 566, 554, 562, 563, 222/567, 548, 80, 81, 83, 89; 220/212
See application file for complete search history.

(56) References Cited

U.S. PATENT DOCUMENTS 1,686,280 A * 10/1928 Keller ..... A23D 7/02 241/169
2,025,378 A * 12/1935 Croasdale, Jr. ..... B01F 7/1695 366/247
2,266,186 A * 12/1941 Fischer ..... A47J 43/105 366/183.1
2,484,391 A * 10/1949 Treiss, Jr. ..... A47J 43/27 141/297
2008/0259723 A1* 10/2008 Rhodes ..... A47J 43/1018 366/247

* cited by examiner

*Primary Examiner* — Donnell Long

(57) ABSTRACT

A package closure embodying a rotatable material stripping element provides a means to close off the package opening and comprises a material stripping element that accommodates the insertion and withdrawal of an external mixing element with a predetermined close fit. Whereas, the said mixing element may be inserted through the closure and into the vessel to mix material contained therein, and after the mixing operation is complete, the material stripping element strips off substantially whatever material residue is sticking to the mixing element as it being withdrawn from the vessel and the closure, thus preventing it from escaping the vessel.

12 Claims, 2 Drawing Sheets

PACKAGE CLOSURE WITH ROTATABLE MATERIAL STRIPPING ELEMENT

CROSS-REFERENCE TO RELATED APPLICATIONS

This application claims priority under 35 U.S. Code §119 of U.S. Provisional Application Ser. No. 62/009,103 filed on Jun. 6, 2014, which is hereby incorporated by reference in its entirety.

FIELD

The field relates to closures, caps, fitments, dispensing apparatuses and the like, that are typically attached to the openings of packages and other portable vessels used for containing and dispensing flowable materials.

BACKGROUND

Flowable materials contained in packages are sometimes subject to settling, or otherwise require mixing before they can be dispensed or otherwise exhibit the characteristics expected of them. Low viscosity materials (e.g. water), can usually be sufficiently mixed simply by shaking the package vigorously before opening it. However, for viscous materials (e.g. pastes, slurries, etc.), that method is often not effective, so direct stirring of the material is required, typically by inserting a mixing element into the package through its opening. Unfortunately, because viscous materials are often very sticky, a significant amount of that material will likely stick to whatever mixing element is inserted into the package as it is being withdrawn, making it very cumbersome and time consuming to mix the material. What is clearly needed is a closure that both covers the package opening and accommodates the insertion and withdrawal of a desired mixing element, such that when the said mixing element is withdrawn, the closure strips off substantially whatever material residue is sticking to the mixing element, thus preventing it from escaping the vessel.

Overview

Disclosed is a closure apparatus embodying a rotatable material stripping element. The apparatus is typically positioned over an opening of a package or other portable vessel containing a material desired to be mixed, and is secured thereto. The closure provides a means to close off the said vessel opening and also comprises a material stripping element that accommodates the insertion and withdrawal of an external mixing element with a predetermined close fit. Whereas, the said mixing element may be inserted through the closure and into the vessel to mix material contained therein, and after the mixing operation is complete, the material stripping element strips off substantially whatever material residue is sticking to the mixing element as it being withdrawn from the vessel and closure, thus preventing it from escaping the vessel.

In at least one embodiment, the closure apparatus rotates as the mixing element is inserted and withdrawn therethrough.

In at least one embodiment, the closure apparatus rotates when the mixing element, inserted therethrough, is rotating, typically when it's mixing material inside the vessel.

In at least one embodiment, the material stripping element portion of the closure apparatus rotates as the mixing element is inserted and withdrawn therefrom, while another portion of the said closure apparatus does not rotate.

In at least one embodiment, the closure apparatus comprises rotatable material stripping element supported, or otherwise held captive by a fitment, typically affixed to a package for containing material desired to be mixed.

In at least one embodiment, the closure apparatus comprises rotatable material stripping element held captive in close communication with the surface of the package containing material desired to be mixed.

In at least one embodiment, the material stripping element portion of the closure apparatus rotates when the mixing element, inserted therethrough, is rotating, while another portion of the said closure apparatus does not rotate.

In at least one embodiment, the closure apparatus accommodates the attachment of a cap or similar means to close off the aperture in the material stripping element when the mixing element is not inserted therethrough.

In at least one embodiment, a cap is integrated into the closure apparatus, such as without out limitation, by means of a living hinge.

In at least one embodiment, the closure apparatus accommodates the attachment of a pour spout or other means to facilitate dispensing of the material from the vessel.

DRAWINGS

DETAILED DESCRIPTION

Figure 1:
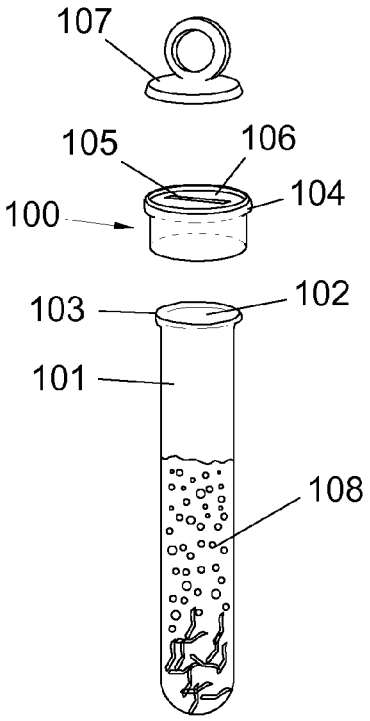
FIG. 1 illustrates an exploded isometric view of a closure apparatus in one embodiment.

FIG. 1 illustrates one embodiment of a closure apparatus 100 designed for a vessel 101, such as a test tube. The said apparatus 100 is preferably constructed to secure to the said vessel 101 in such a way that it both covers the vessel 102 opening and is able to freely rotate when secured thereto. For example, the said apparatus 100 may be pressed over the vessel opening 102 with a friction fit until an internal groove 104 embodied in the closure 100 reaches a lip 103 in the vessel 101, such that an interlock is created, preventing the said closure 100 from being easily removed, but still able to rotate freely as long as the said lip 103 remains captive in the said groove 104. The said closure 100 in this embodiment comprises at least one aperture 105 on its top surface 106 to accommodate the insertion and withdrawal of a desired mixing element (not shown) with a predetermined close fit, which will be explained later in more detail.

After the closure apparatus 100 is secured to the vessel 101, a mixing element is typically inserted through the aperture 105 in the top surface 106 of the closure 100 and then into the vessel 101. The mixing element is then rotated to mix a material 108 contained in the vessel 101, causing the closure apparatus 100 to also rotate along with it. After the mixing operation is complete, the mixing element is withdrawn from the vessel 101 and back through the aperture 105 in the closure 100 which substantially strips off whatever material 108 residue remains sticking to the mixing element, leaving it inside the said vessel 101. The said closure 100 may also accommodate the attachment of a plug 107, cap or similar means to prevent material 108 contained in the vessel 101 from escaping through the closure aperture 105 when the mixing element is not being employed.

Figure 2:
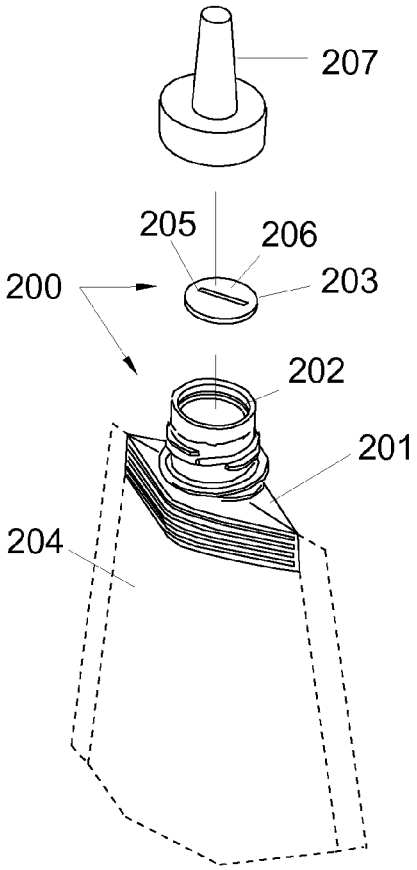
FIG. 2 illustrates an exploded isometric view of a closure apparatus in one embodiment.

FIG. 2 illustrates one embodiment of a closure apparatus 200 with a rotatable material stripping element. The said apparatus 200 comprises a fitment 201 with an internal groove 202 and a material stripping element 203 held captive in the said groove 202. There is enough free space within the said groove 202 for the stripping element 203 to rotate freely, yet not enough room for the said element 203 to be easily removed or otherwise dislodged from the said groove 202. One way the material stripping element 203 may be secured within the groove 202 is by press-fitting it with a predetermined amount of force. Whereas the said element 203 in one embodiment is constructed to slightly flex during the press-fitting operation, and then relax or otherwise spring back to its original shape when it reaches the groove 202 in the fitment 201. The closure apparatus 200 in this embodiment is typically employed in a flexible package 204, such as a stand-up pouch, and the fitment 201 is typically secured to the pouch material by means of heat sealing. In this embodiment, the material stripping element 203 is typically disc shaped with a least one aperture 205 on its top surface 206 to accommodate the insertion and withdrawal of a desired mixing element (not shown) with a predetermined close fit.

After the closure apparatus 200 is secured to the package 204, a mixing element is typically inserted through the aperture 205 in the top surface 206 of the material stripping element 203 and then into the package 204. The mixing element is then rotated to mix a material (not shown) contained in the package 204, causing the material stripping element 203 to also rotate within the groove 202 of the fitment 201, while still remaining captive therein. After the mixing operation is complete, the mixing element is withdrawn from the package 204 and back through the aperture 205 in the material stripping element 203, which substantially strips off whatever material residue remains sticking to the mixing element, leaving it inside the said package 204. If desired, the closure apparatus 200 may also accommodate the attachment of a spout 207 to direct the flow of material when it is being dispensed, or alternatively, a cap, plug or similar means to prevent the material contained in the package 204 from escaping through the aperture 205 when the mixing element is not being employed. If desired, the aperture 205 in the material stripping element 203 may itself serve as a dispensing orifice, and be configured to create a desired flow pattern of the dispensed material by altering its geometry. For example, a viscous material dispensed through an aperture 205 configured as a narrow slot would likely have the shape of a ribbon. Alternatively, the material stripping element 203 may also comprise one or more other apertures (not shown) for the purpose of dispensing the material from the package 204.

Figure 3:
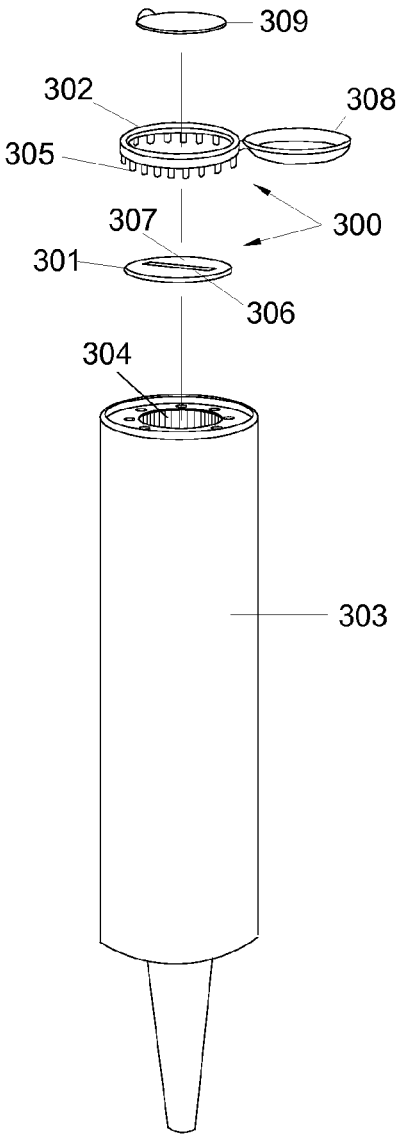
FIG. 3 illustrates an exploded isometric view of a closure apparatus in one embodiment.

FIG. 3 illustrates one embodiment of a closure apparatus 300 with a rotatable material stripping element. In this embodiment, the said apparatus 300 comprises a material stripping element 301 and a retaining member 302. The material stripping element 301 is typically placed on the surface of a package 303 and positioned directly over a predetermined opening 304, such as a die-cut hole in a tube end. The retaining member 302 is placed over the material stripping element 301 and secured to the package 303 surface, thereby holding the said stripping element 301 captive between the surface of the package 303 and the retaining member 302, yet with enough free space between them so that it is able to rotate freely.

The retaining member 302 may be secured to the package 303 surface by any desired means. For example, it may be mechanically attached thereto with pins 305 or spikes at predetermined locations around its periphery. Alternatively, it may be bonded to the package 303 surface, or attached in any number of other commonly known ways. The material stripping element 301 in at least one embodiment is disc shaped with a least one aperture 306 in its top surface 307 to accommodate the insertion and withdrawal of a desired mixing element (not shown) with a predetermined close fit.

In an alternative embodiment (not shown), the retaining member 302 may be secured to the package surface 303 as previously described, or in any other desired way that commonly known. However, the material stripping element 301 in this alternative embodiment is held captive by the retaining member 302 itself, rather than being held captive between the package surface 303 and the retaining member 302. For example, the retaining member 302 may be constructed in the shape of a ring having an internal groove that receives and holds the material stripping element 301 captive therein, but with enough free space within the groove to allow the stripping element 301 to rotate freely. Such a configuration would allow the said stripping element 301 and retaining member 302 to be attached to the package surface 303 as a pre-assembled unit, rather than being separately attached or otherwise placed in position.

In any event, after the closure apparatus 300 is secured to the package 303, a mixing element (not shown) is typically inserted through the aperture 306 in the top surface 307 of the material stripping element 301 and then into the package 303. The mixing element is then rotated to mix the material (not shown) inside the package 303, causing the material stripping element 301 to also rotate, yet still remaining captive underneath the retaining member 302, or alternatively within its inner periphery. After the mixing operation is complete, the mixing element is withdrawn from the package 303 and back through the aperture 306 in the material stripping element 301, which substantially strips off whatever material residue remains sticking to the said mixing element, leaving it inside the said package 303. If desired, the closure apparatus 300 may also accommodate the attachment of a cap 308, plug or similar means to prevent the material contained in the package 303 from escaping through the aperture 306 when the mixing element is not being employed. In at least one embodiment the said cap 308 may be affixed to the retaining member 302 by any desired means, such as a living hinge. If desired, a protective cover 309 may also be applied over the aperture 306 of the material stripping element 301, which in at least one embodiment comprises a peelable film, hermetically sealed to the closure 300 or to a desired surface of the package 303, or to both.

Figure 4:
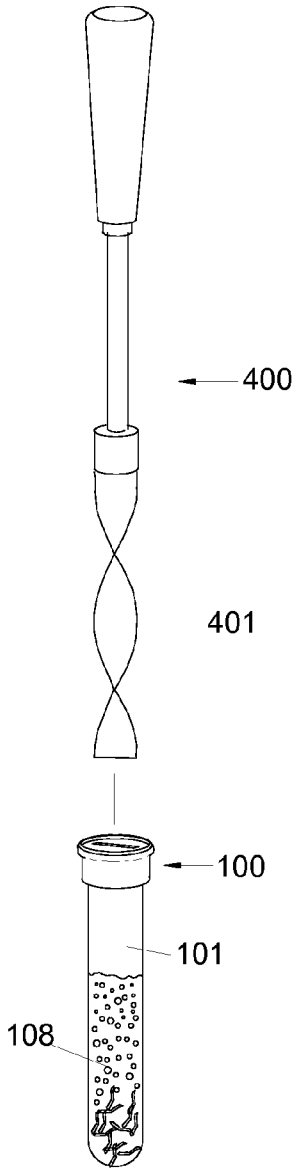
FIG. 4 illustrates an isometric view of a mixing apparatus in one embodiment, comprising helically shaped mixing element and positioned over one embodiment of a closure apparatus secured to a vessel.

FIG. 4 illustrates a mixing tool 400 comprising a mixing element 401 with a configuration that is particularly suitable for mixing viscous materials placed inside a closed vessel. More particularly, the said mixing element 401 comprises a vertically oriented blade, twisted into a helical configuration with a desirable twist/pitch ratio. The said mixing element 401 is shown in FIG. 4 positioned over a vessel 101 containing a material 108 desired to be mixed, with a closure apparatus 100 secured to the vessel 101, and covering its opening 102 (not visible). When the said element 401 is inserted through the closure 100 and into the vessel 101, and then rotated to mix the material 108, the helical configuration of the mixing element 401 generates an excellent extensional and laminar flow of the said viscous material, and because the vessel 101 is closed, a desirable chaotic flow also occurs, resulting in a well-mixed material.

The disclosed embodiments of the closure apparatus 100, 200, 300 are able to accommodate employment of a helically shaped mixing element 401 in part because at least a portion of the said closure 100, 200, 300 is constructed to freely rotate during the mixing operation, when the said mixing element 401, inserted therethrough, is rotating, as well as during removal and insertion of the mixing element 401, when it is typically not rotating. Whereas in that instance, the said closure 100, or alternatively the material stripping element 203, 301 portion of the closure 200, 300 will simply rotate around the helical mixing element 401 as it inserted and withdrawn through its aperture 105, 205, 306, thus allowing its predetermined configuration (e.g. a narrow slot) to maintain a close fit with the said mixing element 401 at every incremental position during its insertion and withdrawal.

It shall be appreciated, other embodiments of the closure apparatus 100, 200, 300 may be constructed without departing from the spirit of the invention, and those disclosed herein are exemplary, and not intended to be a limitation. Furthermore, the various features of the exemplary embodiments are not mutually exclusive, and the teachings from one embodiment may be applied to another embodiment.

What is claimed is:

1. A package closure comprising a rotatable material stripping element with at least one aperture configured to accommodate the insertion and withdrawal of a helically shaped mixing element external from and not integral to the said closure with a predetermined close fit sufficient to strip material residue from the said mixing element and simultaneously cause at least one portion of the said closure to rotate as the said mixing element while not rotating passes through the said aperture, and the said at least one portion of the said closure is held captive at least around its periphery to a predetermined structure comprising an opening.

2. The closure of claim 1 wherein the rotatable material stripping element rotates as the said helically shaped mixing element, having first been inserted therethrough while not rotating, is rotated.

3. The closure of claim 1, wherein the rotatable material stripping element is held captive in close communication with a vessel.

4. The closure of claim 1 wherein the rotatable material stripping element is held captive by a non-rotatable retaining member.

5. The closure of claim 4, wherein the non-rotatable retaining member is a retaining ring.

6. The closure of claim 4, wherein the non-rotatable retaining member is a fitment.

7. The closure of claim 4, wherein the non-rotatable retaining member is affixed to a package.

8. The closure of claim 4, wherein the material stripping element is disc shaped.

9. The closure of claim 1 wherein the closure further embodies a cap.

10. The closure of claim 1 wherein the closure further embodies a removable protective cover over the aperture.

11. The closure of claim 1 wherein the closure further embodies a spout.

12. The closure of claim 1, wherein at least one aperture in the rotatable material stripping element serves as a dispensing orifice.

* * * * *